US010550666B2

(12) United States Patent
Fisher et al.

(10) Patent No.: US 10,550,666 B2
(45) Date of Patent: Feb. 4, 2020

(54) SLOW RESPONSE TIME TOOL

(71) Applicants: Britain A. Fisher, Houston, TX (US); Timothy Cragin, Maitland, FL (US); Jason Allen, Houston, TX (US); Rick Patterson, Santa Fe, TX (US); Douglas J. Lehr, The Woodlands, TX (US); Emily Hanson, Conroe, TX (US)

(72) Inventors: Britain A. Fisher, Houston, TX (US); Timothy Cragin, Maitland, FL (US); Jason Allen, Houston, TX (US); Rick Patterson, Santa Fe, TX (US); Douglas J. Lehr, The Woodlands, TX (US); Emily Hanson, Conroe, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/818,305

(22) Filed: Nov. 20, 2017

(65) Prior Publication Data

US 2019/0153819 A1 May 23, 2019

(51) Int. Cl.
*E21B 34/10* (2006.01)
*E21B 34/00* (2006.01)

(52) U.S. Cl.
CPC ..... *E21B 34/108* (2013.01); *E21B 34/103* (2013.01); *E21B 2034/007* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,046,759 | A * | 7/1936 | Wheaton | F16K 47/023 251/259 |
| 2,968,351 | A * | 1/1961 | Jones | E21B 27/02 166/162 |
| 4,109,725 | A * | 8/1978 | Williamson | E21B 34/108 137/906 |
| 5,992,520 | A * | 11/1999 | Schultz | E21B 34/063 166/264 |
| 6,957,666 | B2 | 10/2005 | Phillips et al. | |
| 6,981,689 | B2 | 1/2006 | Mihaylov et al. | |
| 7,237,573 | B1 | 7/2007 | Graham | |
| 7,819,023 | B2 | 10/2010 | Engler et al. | |
| 2001/0054504 | A1 * | 12/2001 | Carmody | E21B 21/10 166/250.15 |
| 2006/0090803 | A1 * | 5/2006 | Paluncic | G05D 7/0186 138/43 |

* cited by examiner

*Primary Examiner* — Taras P Bemko
*Assistant Examiner* — Ronald R Runyan
(74) *Attorney, Agent, or Firm* — Cantor Colburn LLP

(57) ABSTRACT

A slow response time tool including a biasing arrangement, a piston in operable communication with the biasing arrangement, a chamber receptive to the piston, a retardation arrangement defining a helical pathway in fluid communication with the chamber.

18 Claims, 7 Drawing Sheets

SLOW RESPONSE TIME TOOL

BACKGROUND

Many operations within the resource exploration and recovery industry include actuating various tools such as plugs, valves, etc. Often these are actuated using a pressure threshold. Sometimes the tool is actuated as soon as the pressure threshold is exceeded and sometimes they are actuated after the pressure is reduced below the threshold once the threshold has been met. In either case and in other similar actuation cases, the actuation occurs substantially immediately upon the triggering threshold pressure event. While many operations are suitably managed using these actuation methods, other situations are not as well managed using these methods.

The art would welcome new methods and apparatus that allow for actuation to occur more slowly after threshold pressures are exceeded.

SUMMARY

A slow response time tool including a biasing arrangement, a piston in operable communication with the biasing arrangement, a chamber receptive to the piston, a retardation arrangement defining a helical pathway in fluid communication with the chamber.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

In general, embodiments of a slow response time tool such as a valve are illustrated. By slow response time, it is meant that an event that puts in motion one or more movements leading to opening of the valve to a fully open position or an intermediate position does not result in the immediate action of opening the valve fully or partially but rather starts a process that results in the opening of the valve sometime after the event or causes some other intended movement of a portion of a tool. By "sometime after the event", it is meant a period of time ranging from about 1 minute to as long as is practicably useful such as hours or days after the event before the ultimate intended movement occurs. In some embodiments the originating event is a pressure exceeding a threshold. That pressure may be an applied pressure that is controlled from a remote location in embodiments or may be a pressure that is naturally occurring. The slow response time tool embodiments disclosed herein will register the threshold pressure by reacting in one or more ways to start a process of actuation of the tool that will happen over a selected period of time. Just how long that period of time will be depends upon a retardation arrangement that is specifically configured to provide for the time period. In embodiments, the retardation arrangement may be a fluid pressure drop arrangement, or a mechanical friction arrangement, for example.

Figure 1A:
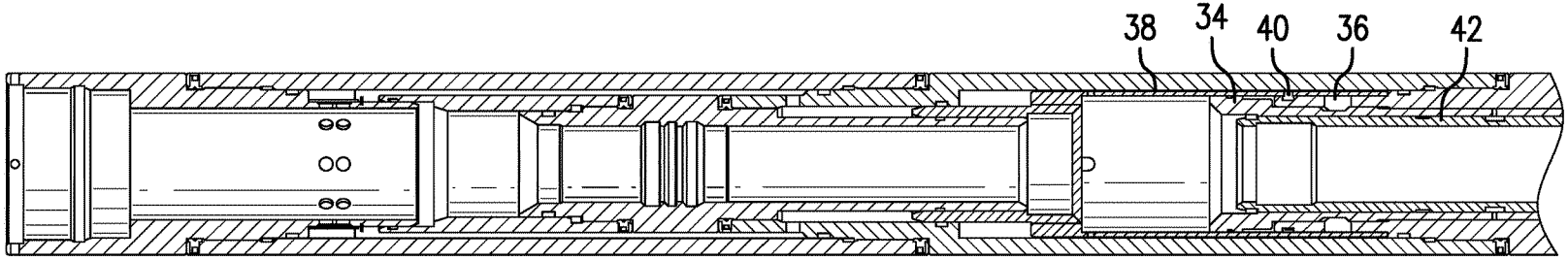
FIG. 1A-C is a cross sectional illustration of an embodiment of a slow response time tool as disclosed herein in a run in position.
Figure 1B:
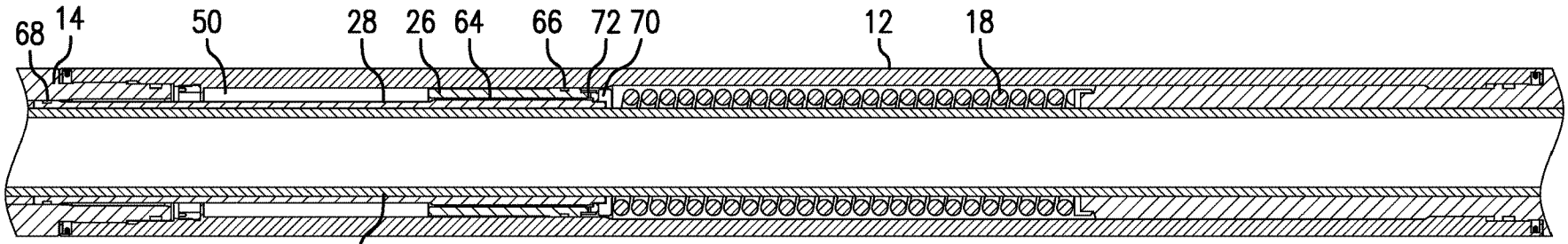
Figure 1C:
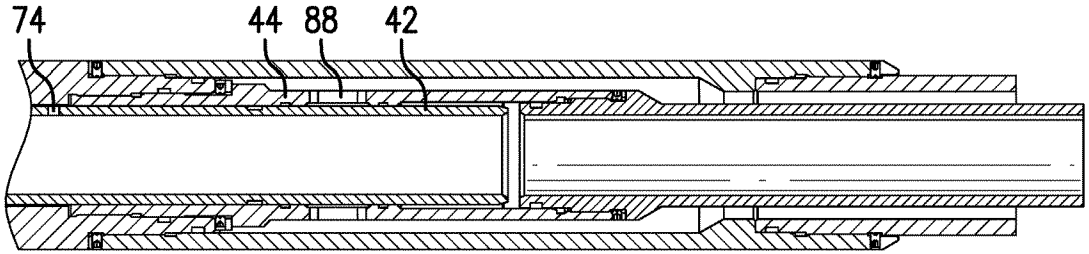

Referring to FIGS. 1A-C, the tool 10 is illustrated as a valve and includes a spring housing 12, a sleeve carrier connector 14 and a lock piston housing 16. Disposed within the spring housing 12 is a biasing arrangement such as a spring 18. The spring bears against a spring guide 20 that abuts against a shoulder 22 that is immobile. At the other axial end of the spring 18, the spring interacts with a retardation arrangement by contacting a spring bearing 24 that in turn abuts a helix piston sleeve 26 and a helix piston mandrel 28. The helix piston mandrel 28 extends to a piston mandrel end 30 that is configured to interact with a sleeve carrier end 32 of a sleeve carrier 34. The sleeve carrier 34 is locked in place during run in by a dog 36 that itself is prevented from disengaging by a lock piston 38. The lock piston 38 is prevented from moving in the run in position by a release member 40 such as a shear screw. Disposed within the components noted, and moveable hydraulically or mechanically is a mandrel 42 that communicates with a ported housing 44 to open or close a flow path that is the focus of the valve 10.

Figure 2A:
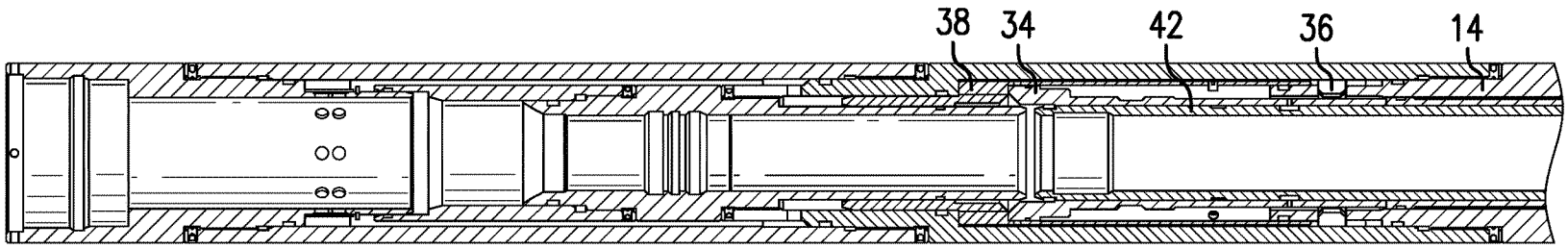
FIG. 2A-C is a cross sectional illustration of the embodiment of FIG. 1 in a hydraulically opened position.
Figure 2B:
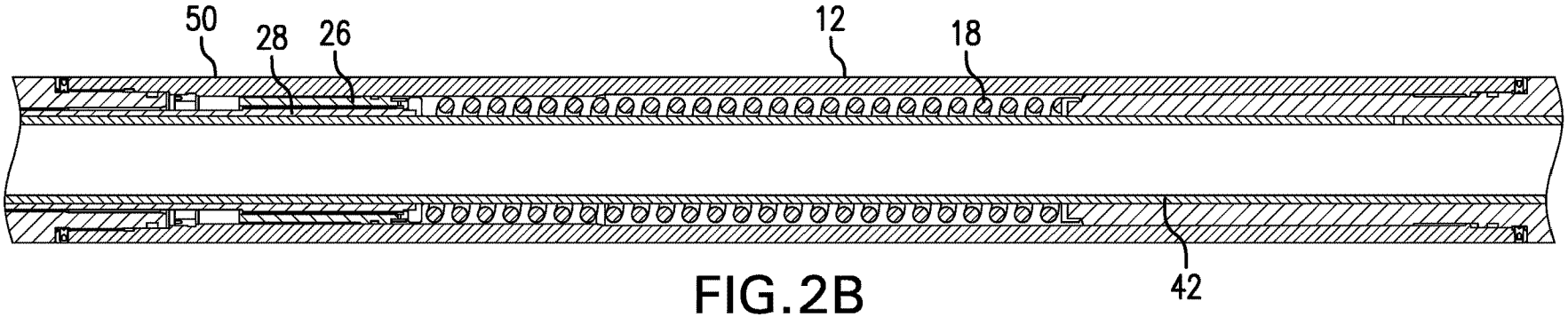
Figure 2C:
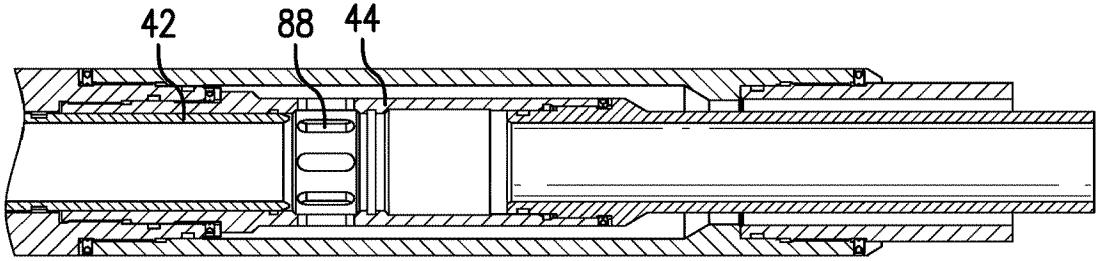

With some of the features of the valve 10 identified, a discussion of function and additional features will be clearer. As an overview, the valve 10 is first subjected to a threshold pressure whereupon the release member 40 releases allowing the lock piston 38 to move biased by the applied pressure. This movement unlocks the valve 10 so that the spring 18, which is compressed during manufacture will expand urging the helix piston 26 and the helix piston mandrel 28 to move against fluid within a ported housing 44. Egress of the fluid in chamber 50 is restricted. The time period required to expel the fluid in chamber 50 is dictated by the retardation arrangement and provides the slow response time for which the valve 10 is designed. In an embodiment, during the expelling of the fluid, the mandrel 42 is moved to uncover at least partially ports 52 in the ported housing 44 thereby completing the opening operation of the valve 10 (see FIGS. 2A-C).

Figure 3:
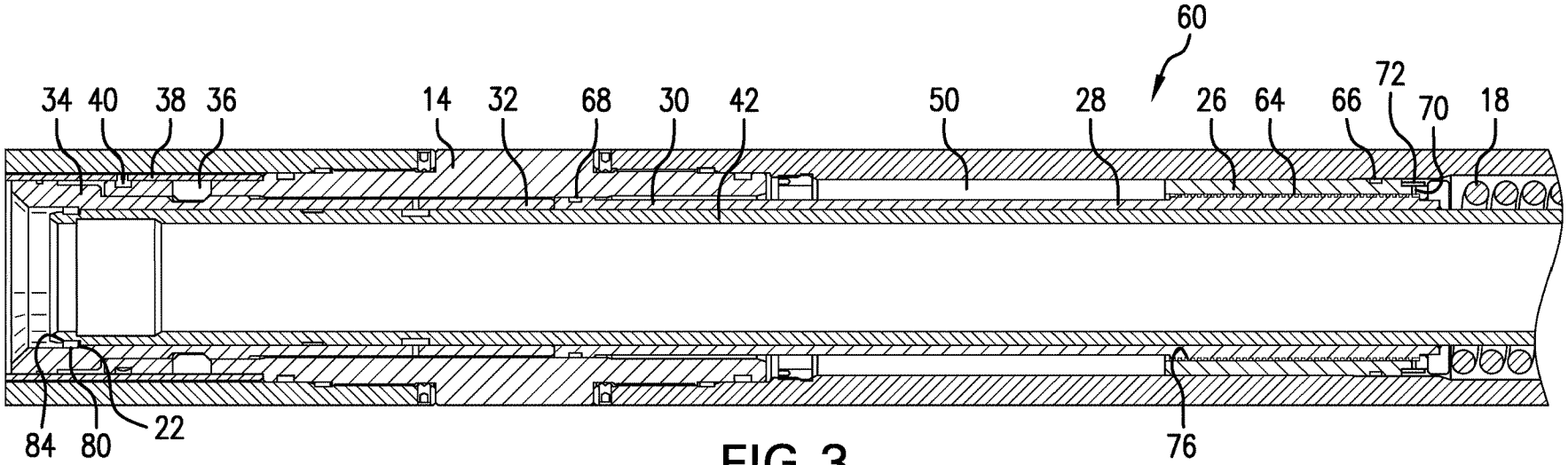
FIG. 3 is an enlarged view of a portion of FIG. 1A-C.
Figure 4:
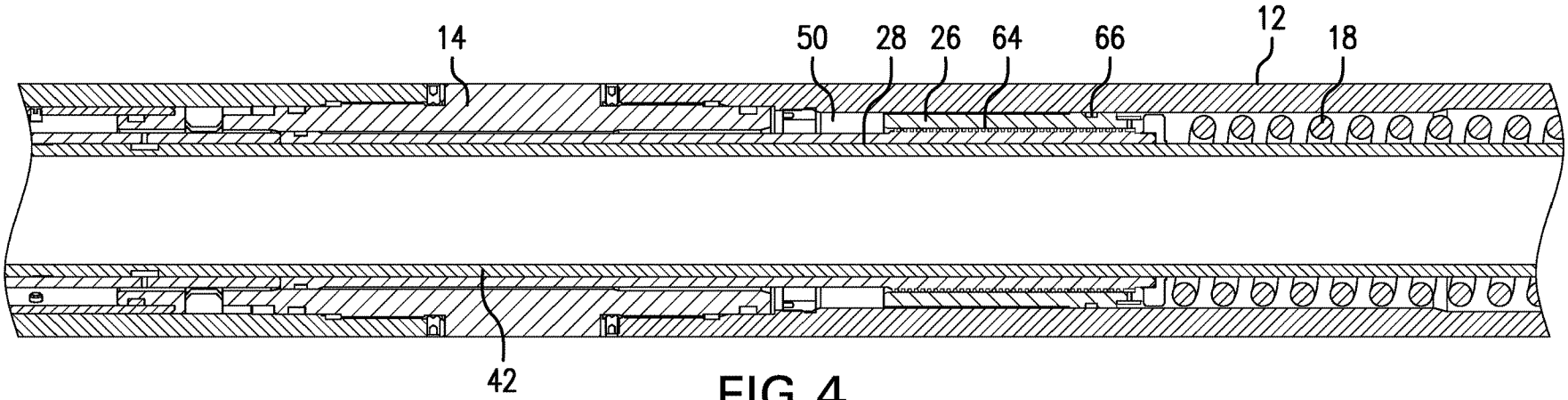
FIG. 4 is an enlarged view of the same portion as FIG. 3 but in the hydraulically open position of FIG. 2A-C.
Figure 5:
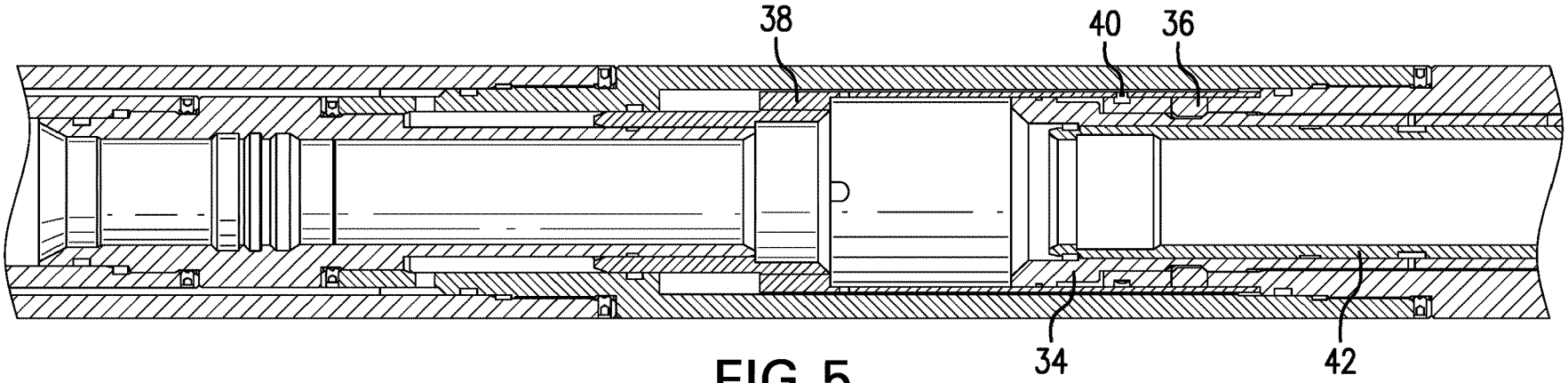
FIG. 5 is an enlarged view of another portion of FIG. 1.
Figure 6:
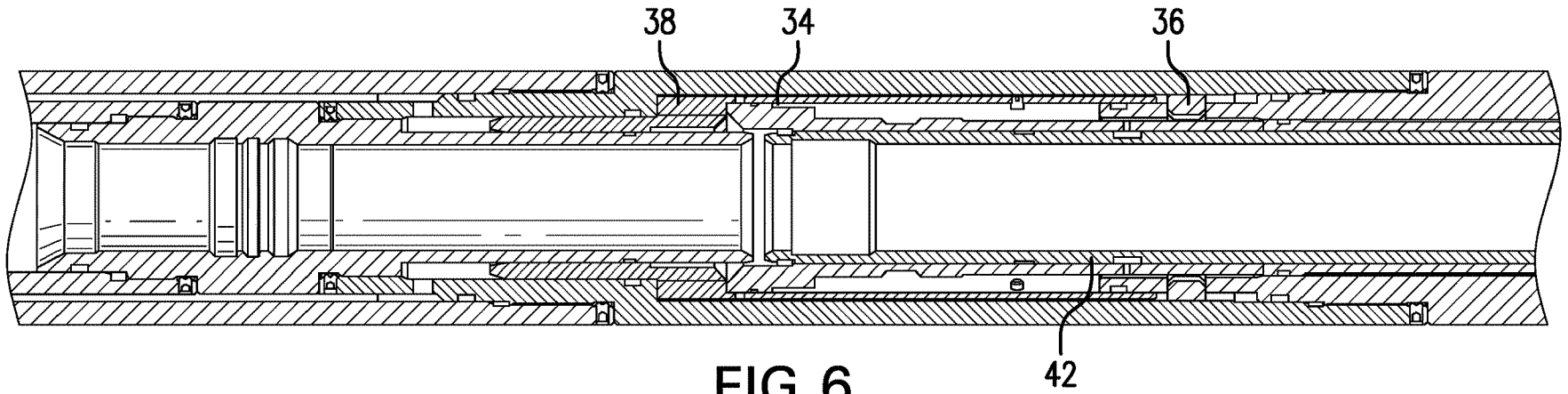
FIG. 6 is an enlarged view of the same portion as FIG. 5 but in the hydraulically open position of FIG. 2A-C.

Two areas of the valve 10 will be better understood through the use of enlarged drawings. These are the areas addressed in FIGS. 3-6. Referring to FIG. 3 first, the spring 18 is an obvious landmark for perceiving from where in FIG. 1 the enlarged figure comes. FIG. 3 is focused upon the retardation arrangement 60 area of the valve 10. Retardation arrangement 60 as illustrated employs a fluid pressure drop configuration in fluid communication with chamber 50. It will be appreciated (other embodiments illustrated and discussed below) that a helical pathway (64 in the embodiment of FIG. 3) having appropriate dimensions and length will create a pressure drop in fluid passing therethrough. To what extent the pressure is dropped depends upon the selected dimensions and length of the pathway and this can be arranged during manufacture of the retardation arrangement 60. A hydraulic diameter of 0.030 inches or greater is contemplated. In one embodiment, the helical pathway is configured to present a cross sectional flow area of 0.003 square inches or greater. This will provide resistance to plugging from particulate matter and yet work well with selected length options to create the desired pressure drops to be associated with the selected period of time over which the slow response time actuation is to occur. The pathway may be a part of a piston or may extend in fluid communication from the chamber 50 in any direction or through any component that defines the chamber 50. In order for the slow response time valve to function as intended, fluid from the chamber 50 must be expelled through the retardation arrangement pathway and the pathway must have sufficient pressure drop over its length to create the time period required for that fluid to traverse the pathway and hence the time period over which the valve movement is delayed. Fluid expelled through the pathway may be to the annulus, the ID and/or other locations not detrimental to operation of the tool 10.

In the FIG. 3 embodiment, the retardation arrangement 60 comprises the helix piston 26 and the helix piston mandrel 28. The helix piston 26 is in sealing communication with the spring housing 12 at seal 66, which may be an o-ring seal. An opposite end of chamber 50 is sealed with a seal 68 so that although the helix piston 26 and the helix piston mandrel 28 are moveable, fluid within chamber 50 will be contained therein other than for the existence of pathway 64. The helix piston 26 also defines a port 70 and supports a filter 72. The port 70 and filter 72 are configured to allow downhole fluid to pass into the chamber 50 during running so that chamber 50 is not required to be filled during manufacture or at the rig site. This saves time and reduces leak possibilities during storage. Downhole fluids access the port 70 through mandrel 42 at opening 74. The filter 72 prevents debris or larger solids content in the downhole fluid from entering the chamber 50.

The helix piston mandrel 28 includes a helical upset 76 thereon that in some embodiments will be an ACME thread, though it is to be understood that other types of threads may also be used and indeed even other constructions that are not threads but that provide a helical upset may also be used. As with any thread or similar geometry, a crest will define the major diameter of the upset 76 and that diameter is used to determine the inside diameter surface 78 of the helix piston 26 (or surface 78 could be selected first and then be used to define the upset diameter instead) such that the crest of the thread will have an interference contact with the inside surface 78. There is however no mating thread on the inside diameter surface 78 but rather there is merely a cylindrical surface there. Accordingly, there is a space formed between the root of the threadform, the flanks of the threadform and the surface 78 bridging between adjacent crests of the threadform. The result is the pathway 64 noted above. The cross sectional dimensions of this pathway are dictated by how the upset 76 is configured with embodiments being 0.003 square inches or greater and the length of the pathway 64 may be adjusted as desired during manufacture to achieve an appropriate pressure drop for the desired time period over which the fluid within the chamber 50 may be expelled through the pathway 64. It is also to be appreciated that although the upset 76 is described above as extending radially outwardly from the helix piston mandrel, it could easily be positioned on the ID of the helix piston and extend radially inwardly. More generically, the upset 76 should be considered to extend in a generally radial direction from one member to another member in order to form the pathway 64. Furthermore, it is to be understood that although the above described iterations of the configuration of the pathway 64 utilize two components (e.g. helix piston and helix piston mandrel) that work together to create the pathway, it is also contemplated to form the retardation arrangement in a single component such as a single piece piston, etc. using additive manufacture wherein the otherwise difficult to obtain by traditional machining pathway can be easily created.

As noted, the chamber 50 is filled with fluid during running through the opening 74. During this time, the spring 18 is maintained in place because the helix piston mandrel 28 is temporarily restrained by something that can be released through applied pressure or other remote event. In the case of the embodiment of FIG. 1 and referring to FIGS. 3 through 6 together, the helix piston mandrel 28 abuts the sleeve carrier 34, which cannot move due to dog 36. With dog 36 in the run in position, the spring 18 remains in the compressed position awaiting release and attendant valve actuation. The dog 36 cannot move out of the run in position until the lock piston 38 due to applied pressure is caused to release the release mechanism 40. The release mechanism is shown as a shear screw. When pressure reaches the selected threshold where the release mechanism releases, the lock piston is free to move in the leftward direction of the figure to unsupport the dog 36 (see FIG. 4). At this point, the spring is no longer hindered but may apply its biasing force to the helix piston 26 and helix piston mandrel 28. This force will be partially balanced by the incompressibility of the fluid in chamber 50. Because of the pathway 64 however, the fluid opposing the spring 18 will slowly escape the chamber through the pathway 64. The escaping fluid results in the chamber 50 becoming dimensionally smaller and the helix piston mandrel 28 moving leftwardly in the Figure. Since the sleeve carrier 34 also must move leftwardly of the figure under the impetus of the helix piston mandrel 28, the movement of the sleeve carrier 34 may be harnessed for valve actuation. The sleeve carrier 34 includes a snap ring 80 or other similar structure that bears against shoulder 82 of the sleeve carrier 34. The snap ring 80 is also configured to bear against a mandrel shoulder 84 of the mandrel 42. This configuration, it will be appreciated, will force the mandrel 42 to move leftwardly of the figure along with the sleeve carrier 34. Returning to FIGS. 1A-C and 2A-C, it can be seen that at an opposite end of the mandrel 42 from the snap ring 80, is moved from a position where ports 88 of the ported housing 44 are blocked to a position where the ports 88 are open. It should be understood that the stroke of any of the components of the valve 10 described may be adjusted to promote a partially open condition of the ports 88, if desired.

Figure 7A:
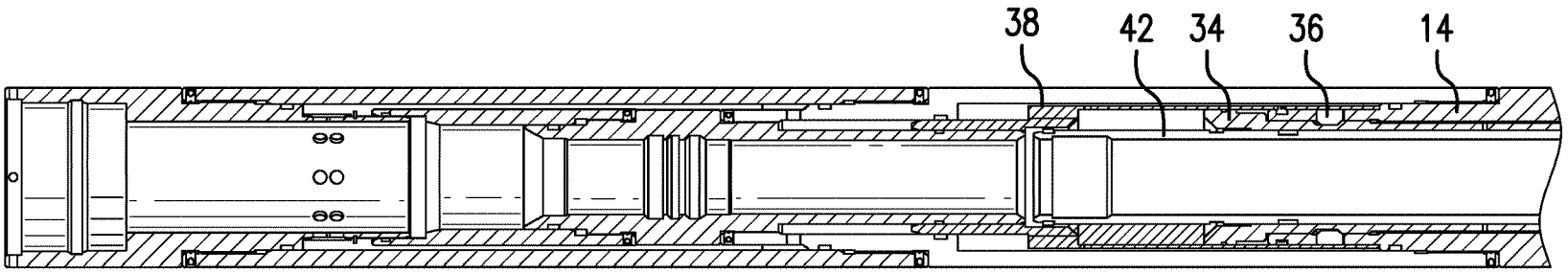
FIG. 7A-C is a cross sectional illustration of the embodiment of FIG. 1A-1C in a mechanically opened position.
Figure 7B:
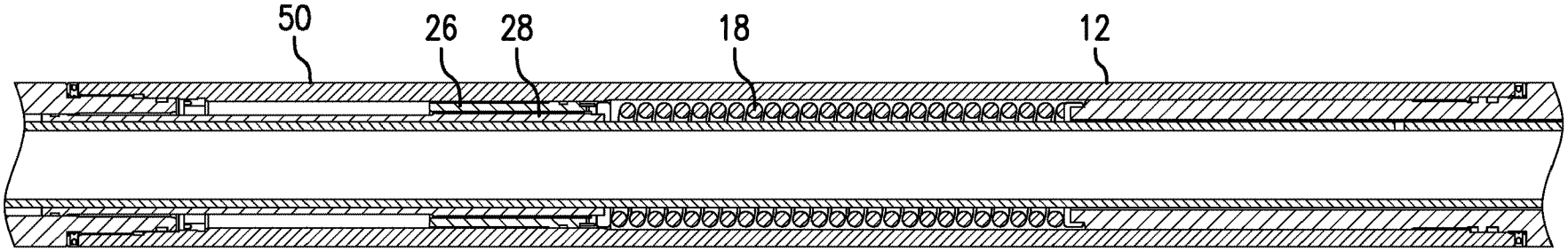
Figure 7C:
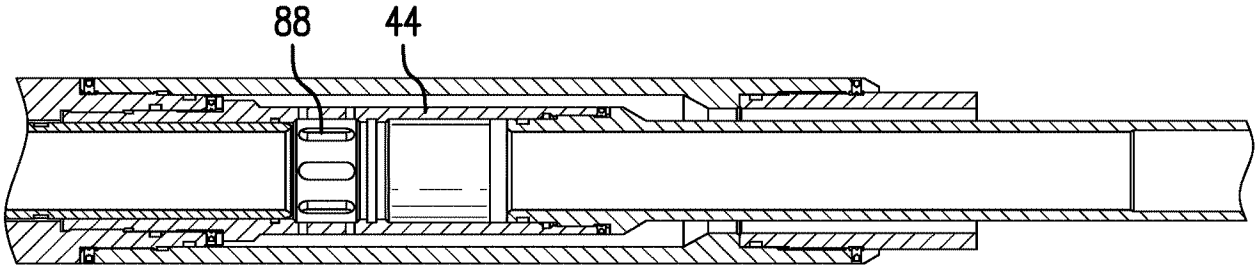

It is to be understood that the valve 10 also has the capability of being mechanically shifted by a shifting tool (not shown) if there be a need to do so, that need including without limitation that the hydraulic method described above fails for any reason. This is illustrated in FIG. 7A-C. It may have been appreciated by the reader during the discussion of the snap ring 80 that the shoulders 82 and 84 with which that snap ring 80 communicates are only load bearing in one direction of movement. That direction supports the sleeve carrier 34 forcing the mandrel 42 to move to open the ports 88 but if the sleeve carrier 34 does not move, then the mechanical backup can be run through the valve 10 into the inside of the mandrel 42 to engage profile 90 therein. A pull with the shifting tool on profile 90 will cause the mandrel 42 to move within the sleeve carrier 34 and open the ports 88. The ports 88 may also be closed mechanically by reversing the direction of impetus from the shifting tool (not shown).

Figure 8:
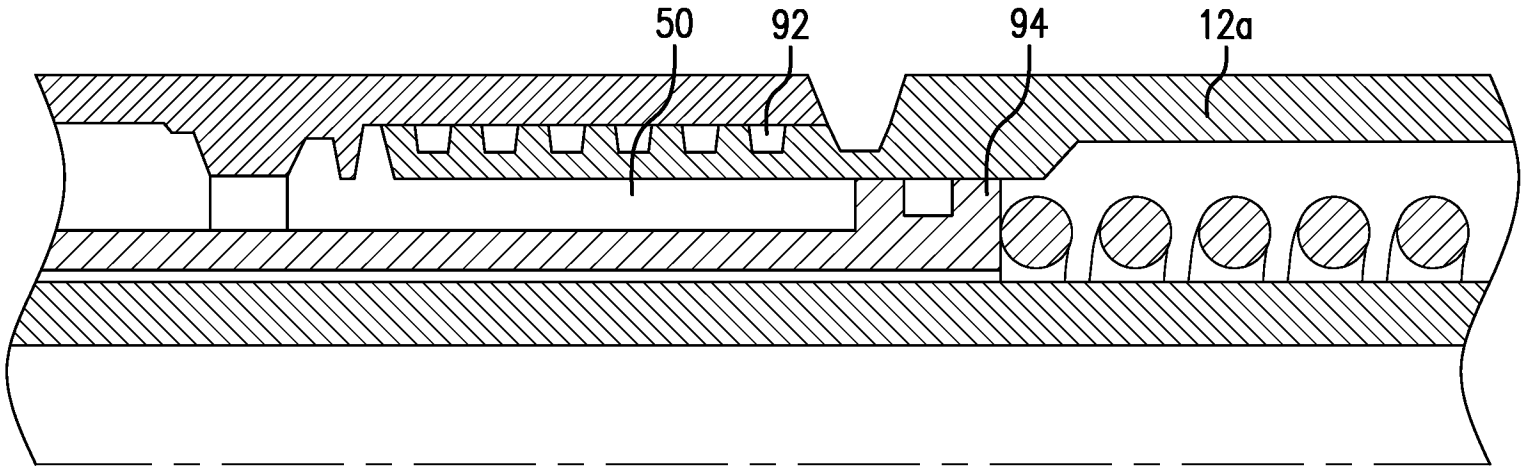
FIG. 8 is an enlarged view of the retardation arrangement area of another embodiment of the slow response time valve.

Referring to the original discussion above of the retardation arrangement 60 it was noted that other embodiments for facilitating expulsion of fluid from the chamber 50 are contemplated. One of these is illustrated in FIG. 8 and another in FIG. 9. In the FIG. 8 illustration, it will be appreciated that spring housing 12*a* has been modified with a helix flow path 92 therein. The helix piston 26 and helix piston mandrel 28 are replaced with a traditional piston 94 and force applied to the piston 94 causes the fluid to exit the chamber 50 through the path 92. In an iteration, the housing will be constructed in two pieces to facilitate construction of the path 92 similarly to the construction of pathway 64 above. In other respects the embodiment of FIG. 8 is substantially the same as the embodiment of FIG. 1 and functions substantially identically thereto other than fluid infiltration to chamber 50, which will occur through path 92 as opposed to through helix piston port 70 (which does not exist in the embodiment of FIG. 8).

Figure 9:
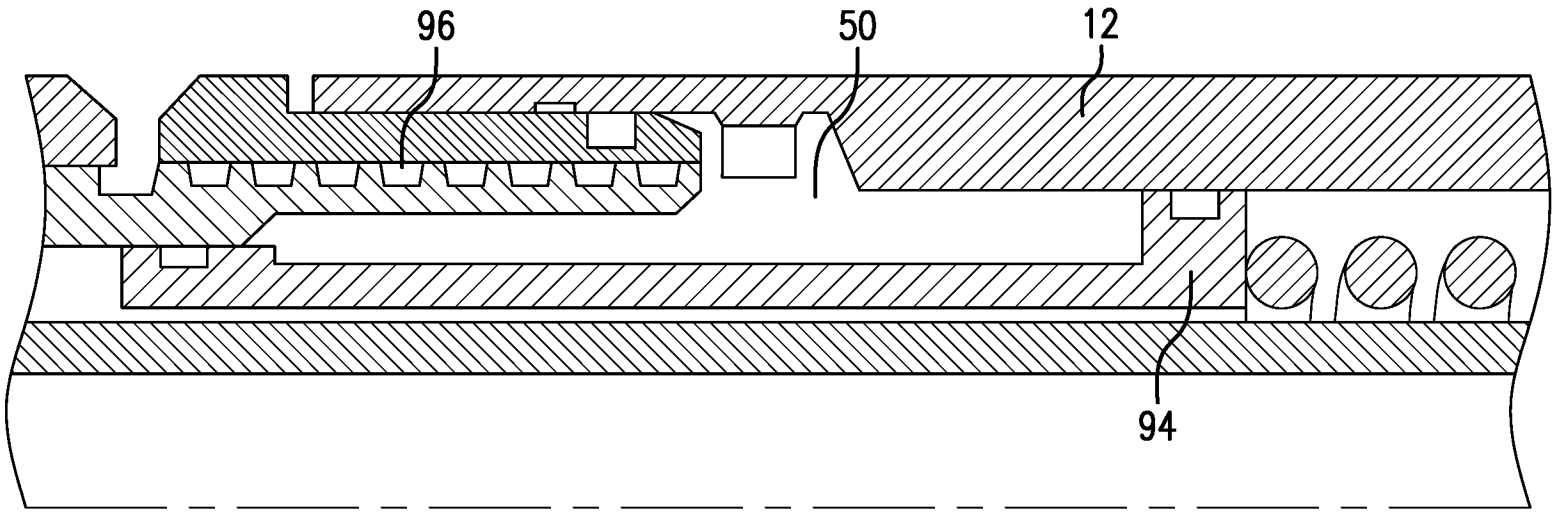
FIG. 9 is an enlarged view of the retardation arrangement area of another embodiment of the slow response time valve.

Referring to FIG. 9, another alternative embodiment is illustrated wherein a sleeve carrier connector 94 is modified to present a helix flow path 96 for fluid expulsion from the chamber 50. In an iteration, the connector 94 will be constructed in two pieces to facilitate construction of the path 96 similarly to the construction of pathway 64 above. This embodiment uses the traditional piston 94 as like the FIG. 8 embodiment and again provides an alternative fluid egress path. In each of FIGS. 8 and 9, since fluid egress is still through a helix path, the pressure drop and hence the slow response time valve actuation is maintained.

It will also be understood that the embodiments of FIGS. 8 and 9 may also be formed using an additive manufacture process so that a single component will house the helical pathway rather than two components working together to form the pathway.

The above embodiments describe the initial triggering event to be pressure but it is to be understood that the original triggering event may be one or more of pressure, mechanical input, chemical activity, acoustic input, or temperature, or any other similar applicable event wherein the release member may be configured to respond to such triggering event. In other respects the slow response time tool will function equivalently.

Set forth below are some embodiments of the foregoing disclosure:

Embodiment 1

A slow response time tool including a biasing arrangement, a piston in operable communication with the biasing arrangement, a chamber receptive to the piston, a retardation arrangement defining a helical pathway in fluid communication with the chamber.

Embodiment 2

The tool as in any prior embodiment, wherein the biasing arrangement is a spring.

Embodiment 3

The tool as in any prior embodiment, wherein the piston comprises a helix piston and a helix piston mandrel that together form the retardation arrangement.

Embodiment 4

The tool as in any prior embodiment, wherein the helix piston mandrel includes a helical upset thereon.

Embodiment 5

The tool as in any prior embodiment, wherein the upset is a thread.

Embodiment 6

The tool as in any prior embodiment, wherein the helical upset defines a crest and the helix piston bridges the crests of the upset to form the helical pathway.

Embodiment 7

The tool as in any prior embodiment, wherein the retardation arrangement is a fluid pressure drop arrangement.

Embodiment 8

The tool as in any prior embodiment, wherein the fluid pathway has a hydraulic diameter of 0.030 inches or greater.

Embodiment 9

The tool as in any prior embodiment, wherein the fluid pathway has a cross sectional flow area of greater than or equal to 0.003 square inches.

Embodiment 10

The tool as in any prior embodiment, wherein the helical pathway is through a housing surrounding the chamber.

Embodiment 11

The tool as in any prior embodiment, wherein the housing is a spring housing.

Embodiment 12

The tool as in any prior embodiment, wherein the fluid pathway is through a connector to a housing surrounding the chamber.

Embodiment 13

The tool as in any prior embodiment, further including a release member preventing the biasing member from moving until released.

Embodiment 14

The tool as in any prior embodiment, wherein the release member is releasable by a threshold pressure.

Embodiment 15

The tool as in any prior embodiment, wherein the tool is a valve.

Embodiment 16

The tool as in any prior embodiment, wherein the valve includes a mandrel movable to uncover or cover ports in a ported housing connected to the tool.

Embodiment 17

The tool as in any prior embodiment, wherein the mandrel includes a profile configured for mechanical manipulation of the mandrel.

Embodiment 18

The tool as in any prior embodiment, wherein the release member is responsive to one or more of pressure, mechanical input, chemical activity, acoustic input, or temperature.

Embodiment 19

The tool as in any prior embodiment, wherein the retardation arrangement is a one piece component housing the helical pathway or path.

Embodiment 20

The tool as in any prior embodiment, wherein the retardation arrangement is additively manufactured.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A slow response time tool comprising:

a biasing arrangement arranged to bias the tool to a second position from a first position, the biasing arrangement including a release member preventing the biasing member from moving until released by a threshold fluid pressure;

a piston in operable communication with the biasing arrangement the piston positioned to resist movement of the biasing arrangement;

a chamber receptive to the piston;

a retardation arrangement defining a helical pathway in fluid communication with the chamber, the helical pathway providing a time delayed escape path for fluid from the chamber thereby resisting piston movement into the chamber, resisting movement of the biasing arrangement and resisting movement of the tool to the second position, thereby slowing response time of the tool after an actuation event.

2. The tool as claimed in claim 1 wherein the biasing arrangement is a spring.

3. The tool as claimed in claim 1 wherein the piston comprises a helix piston and a helix piston mandrel that together form the retardation arrangement.

4. The tool as claimed in claim 3 wherein the helix piston mandrel includes a helical upset thereon.

5. The tool as claimed in claim 4 wherein the upset is a thread.

6. The tool as claimed in claim 4 wherein the helical upset defines a crest and the helix piston bridges the crests of the upset to form the helical pathway.

7. The tool as claimed in claim 1 wherein the retardation arrangement is a fluid pressure drop arrangement.

8. The tool as claimed in claim 1 wherein the fluid pathway has a hydraulic diameter of 0.030 inches or greater.

9. The tool as claimed in claim 1 wherein the fluid pathway has a cross sectional flow area of greater than or equal to 0.003 square inches.

10. The tool as claimed in claim 1 wherein the helical pathway is through a housing surrounding the chamber.

11. The tool as claimed in claim 10 wherein the housing is a spring housing.

12. The tool as claimed in claim 1 wherein the helical pathway is through a connector to a housing surrounding the chamber.

13. The tool as claimed in claim 1 wherein the tool is a valve.

14. The tool as claimed in claim 13 wherein the valve includes a mandrel movable to uncover or cover ports in a ported housing connected to the tool.

15. The tool as claimed in claim 14 wherein the mandrel includes a profile configured for mechanical manipulation of the mandrel.

16. The tool as claimed in claim 1 wherein the release member is responsive to one or more of pressure, mechanical input, chemical activity, acoustic input, or temperature.

17. The tool as claimed in claim 1 wherein the retardation arrangement is a one piece component housing the helical pathway or path.

18. The tool as claimed in claim 17 wherein the retardation arrangement is additively manufactured.

* * * * *